US009957688B2

(12) United States Patent
Hall

(10) Patent No.: US 9,957,688 B2
(45) Date of Patent: May 1, 2018

(54) EXCAVATOR BUCKET

(71) Applicant: SPADEBLADE PTY LTD, Bulimba, Brisbane, Queensland (AU)

(72) Inventor: David Hall, Toowoomba (AU)

(73) Assignee: SPADEBLADE PTY LTD, Queensland (AU)

( * ) Notice: Subject to any disclaimer, the term of this patent is extended or adjusted under 35 U.S.C. 154(b) by 0 days. days.

(21) Appl. No.: 14/434,186

(22) PCT Filed: Oct. 8, 2013

(86) PCT No.: PCT/AU2013/001155
§ 371 (c)(1),
(2) Date: Apr. 8, 2015

(87) PCT Pub. No.: WO2014/056027
PCT Pub. Date: Apr. 17, 2014

(65) Prior Publication Data

US 2015/0275467 A1 Oct. 1, 2015

(30) Foreign Application Priority Data

Oct. 8, 2012 (AU) ..... 2012904381

(51) Int. Cl.
*E02F 3/40* (2006.01)

(52) U.S. Cl.
CPC ..... *E02F 3/40* (2013.01)

(58) Field of Classification Search
CPC ..... E02F 3/40; E02F 3/28; E02F 3/401; E02F 9/2883

(Continued)

(56) References Cited

U.S. PATENT DOCUMENTS 2,393,432 A * 1/1946 Turner ..... E02F 3/60 299/67
2,584,416 A * 2/1952 Boehringer ..... E02F 3/40 37/444

(Continued)

FOREIGN PATENT DOCUMENTS

AU 2002301250 B2 6/2003
EP 0381555 A1 * 8/1990 ..... E02F 3/40

(Continued)

OTHER PUBLICATIONS

International Search Report Corresponding to PCT/AU2013/001155 dated Dec. 20, 2013.

(Continued)

*Primary Examiner* — Robert E Pezzuto
*Assistant Examiner* — Joan D Misa
(74) *Attorney, Agent, or Firm* — Davis & Bujold PLLC; Michael J. Bujold

(57) ABSTRACT

A bucket for an excavator or loader including a base wall having a side with a substantial or partly concave shape, the side with the substantial or partly concave shape has a front section that is raised, flat or concave and a rear section that has a concave arc. The base wall side has a discontinuous curve from the front section to the rear section. The bucket has two side walls spaced apart by the base wall. The bucket has mounting mechanism for mounting the bucket to the excavator or loader. The raised, flat or concave front section assists in retaining excavated material within the bucket.

10 Claims, 3 Drawing Sheets

(58) Field of Classification Search
USPC ..... 37/444, 443, 264, 398, 903, 379, 409, 37/411
See application file for complete search history.

(56) References Cited

U.S. PATENT DOCUMENTS 2,838,856 A * 6/1958 Buisse ..... E02F 3/405 37/404
3,775,879 A * 12/1973 Quick ..... E02F 3/40 29/457
3,791,054 A * 2/1974 Bierwith ..... E02F 3/241 198/509
4,238,896 A * 12/1980 Lanz ..... E02F 9/2808 37/449
4,805,703 A * 2/1989 Carlsson ..... E02F 7/06 171/132
4,991,662 A * 2/1991 Caron ..... E02F 3/815 172/701.1
5,392,864 A * 2/1995 Lindenmuth ..... E02F 3/815 172/701.1
5,680,717 A * 10/1997 Bierwith ..... E02F 9/285 37/341
D477,610 S * 7/2003 Matsumoto ..... D15/11
6,662,480 B1 * 12/2003 Stevens ..... E02F 3/4075 172/817
6,938,701 B2 * 9/2005 Matsumoto ..... E02F 3/7618 172/811
D534,929 S * 1/2007 Matsumoto ..... D15/32
D538,307 S * 3/2007 Matsumoto ..... D15/32
7,191,846 B2 * 3/2007 Matsumoto ..... E02F 3/815 172/811
7,654,336 B2 * 2/2010 Matsumoto ..... E02F 3/7618 172/811
7,690,441 B2 * 4/2010 Matsumoto ..... E02F 3/8152 172/811
8,046,982 B1 * 11/2011 Schutz ..... A01D 11/00 294/1.3
8,052,193 B2 * 11/2011 Liebert ..... B60R 13/01 296/183.1
8,291,624 B2 * 10/2012 Hall ..... E02F 3/431 172/701.1
8,701,313 B2 * 4/2014 Hall ..... E02F 3/40 172/701.1
9,096,988 B2 * 8/2015 Price ..... A01B 1/02
2007/0209811 A1 9/2007 Matsumoto et al.
2010/0031538 A1 * 2/2010 Hall ..... E02F 3/431 37/195
2011/0265353 A1 * 11/2011 Kaplan ..... E01H 5/02 37/197
2013/0037287 A1 * 2/2013 Hall ..... E02F 3/40 172/824

FOREIGN PATENT DOCUMENTS

FR 2540905 A1 * 8/1984 ..... B07B 1/00
JP 58195634 A * 11/1983
WO 2008/028225 A1 3/2008

OTHER PUBLICATIONS

Written Opinion Corresponding to PCT/AU2013/001155 dated Dec. 20, 2013.

* cited by examiner

EXCAVATOR BUCKET

This application is a National Stage completion of PCT/AU2013/001155 filed Oct. 8, 2013, which claims priority from Australian patent application serial no. 2012904381 filed Oct. 8, 2012.

FIELD OF INVENTION

The present invention relates to excavator buckets and loader buckets. Reference and comments in the specification to excavator buckets also apply to loader buckets unless otherwise specified.

BACKGROUND OF THE INVENTION

Excavator buckets are used by excavators and like vehicles to dig the earth and remove dirt. Conventional excavator buckets have a concave base wall separating two side walls that together form a bucket shape. Many of the excavator buckets have a series of teeth on the leading edge to penetrate the ground.

Because of the impact forces associated with penetrating and digging the ground, the excavator buckets have walls of thickened metal plates to withstand these forces. The hydraulic-operated arms of the excavators can lift loaded buckets up to a maximum threshold weight. As the buckets are relatively heavy because they are made of the thick metal plates, there is a limit to the amount of dirt it can carry before the maximum threshold weight limit is reached.

Furthermore, conventional buckets have a concave shape to hold and retain the collected dirt. However, collecting dirt with a concave shaped bucket has problems in that collected dirt flowing into the bucket sometimes falls out of the concave shaped bucket. There is a maximum volume of dirt collected and retained by the bucket because of the shape of the bucket.

OBJECT OF THE INVENTION

It is an object of the present invention to provide an alternate excavator bucket that overcomes at least in part one or more of the abovementioned disadvantages.

SUMMARY OF THE INVENTION

The current invention was developed by the inventor's realization that the dirt flowing into a concave shaped bucket causes material to compact and restrain flow at the cutting edges or teeth and this compaction causes dirt to stick to the bucket thereby reducing its loading capacity.

In one aspect the present invention broadly resides in bucket for an excavator or loader including a base wall having a side with a substantial or partly concave shape, said side with the substantial or partly concave shape has a front section that is raised, flat or concave and a rear section that has a concave arc;

two side walls spaced apart by the base wall;

mounting means to mount the bucket to the excavator or loader; wherein the base wall side has a discontinuous curve from the front section to the rear section.

Preferably, the shape of the front section is discontinuous and not aligned with the arc of the concave shape of the rear section of the base wall side.

Preferably the front section is spaced between the cutting edge or teeth and the rear section and the cutting edge is discontinuous with the front section and the front section is discontinuous with the rear section.

In a preferred embodiment, the front section has a convex shape and the rear section has a concave shape.

Preferably, the raised shape or convex shape of the front section serves to form a discontinuity with the rear section and assist in retaining excavated material within the bucket.

In an alternate embodiment, the shape of the front section is flat or has a concave arc that has a less of a degree of curvature than the concave arc of the rear section and the front section is discontinuous in shape with the rear section.

In another aspect, the invention broadly resides in a bucket for an excavator or loader including a base wall having a side with a substantial or partly concave shape, said side with the substantial or partly concave shape has a front section that is raised, flat or concave and a rear section that has a concave arc;

two side walls spaced apart by the base wall;

mounting means to mount the bucket to the excavator or loader; wherein the base wall has a front section that has a convex shape that is discontinuous with the concave arc of a rear section of the base wall.

Preferably the front section has a central convex or raised shape with sloping sides and the central convex or raised shape with sloping sides is discontinuous with the concave arc of a rear section of the base wall. Preferably the front section has a central convex portion that slopes towards the side walls. The central convex portion preferably forms an elongate domed portion.

In a further aspect, the invention broadly resides in a bucket for an excavator or loader including a base wall having a side with a substantial or partly concave shape, said side with the substantial or partly concave shape has a front section that is raised, flat or concave and a rear section that has a concave arc;

two side walls spaced apart by the base wall;

mounting means to mount the bucket to the excavator or loader; wherein the base wall has a front section that has a central convex or raised shape with sloping sides, the central convex or raised shape with sloping sides of the front section is discontinuous with the concave arc of a rear section of the base wall.

In a further aspect, the invention broadly resides in a bucket for an excavator or loader including a base wall having a side with a substantial or partly concave shape, said side with the substantial or partly concave shape has a front section that is raised, flat or concave and a rear section that has a concave arc;

two side walls spaced apart by the base wall;

mounting means to mount the bucket to the excavator or loader; wherein the base wall has a front section that has a central convex or raised shape with sloping sides, the central convex or raised shape with sloping sides of the front section is discontinuous with the concave arc of a rear section of the base wall; wherein the front section of the base wall cooperates with the concave shaped rear section to direct excavated material outwardly from the centre of the front section to the side walls.

With the preferred embodiment of a bucket with a convex shaped front section, the thickness of the metal plates for the base wall is preferably reduced because the convex shape of the front section provides structural strength to the bucket.

The free leading edge of the front section may have a plurality of teeth protruding outwardly to assist in penetrating the ground.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENT

Figure 1:
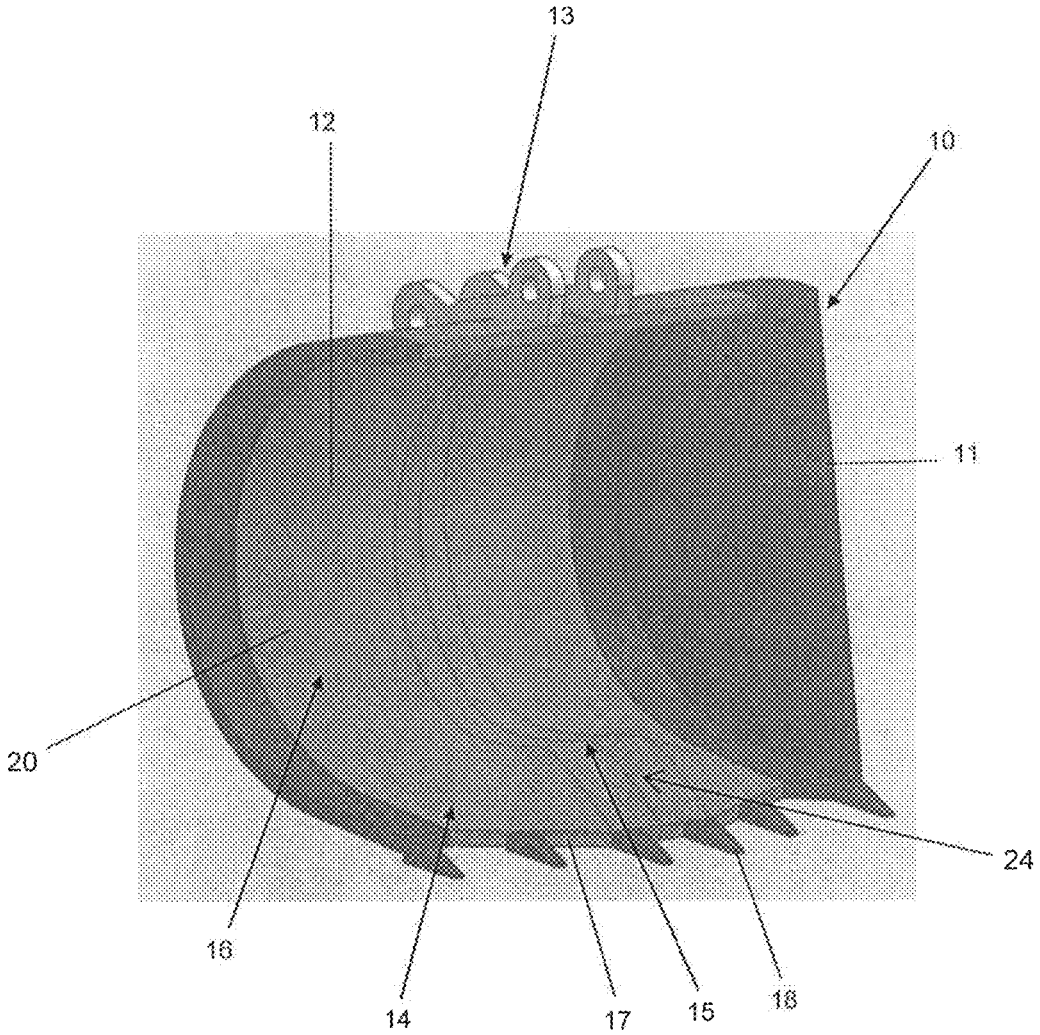
FIG. 1 is a diagrammatic front view (with the cutaway of one side wall) of the preferred embodiment of the excavator bucket.
Figure 2:
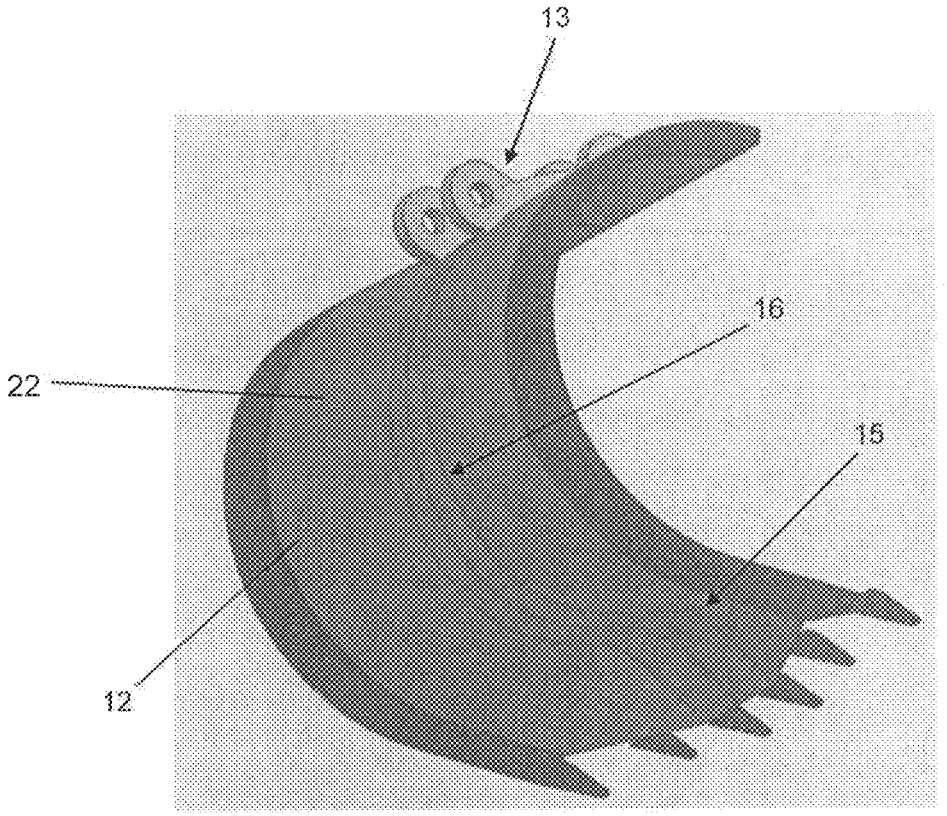
FIG. 2 is a diagrammatic rear side view (with the cutaway of one side wall) of the preferred embodiment of the excavator bucket.
Figure 3:
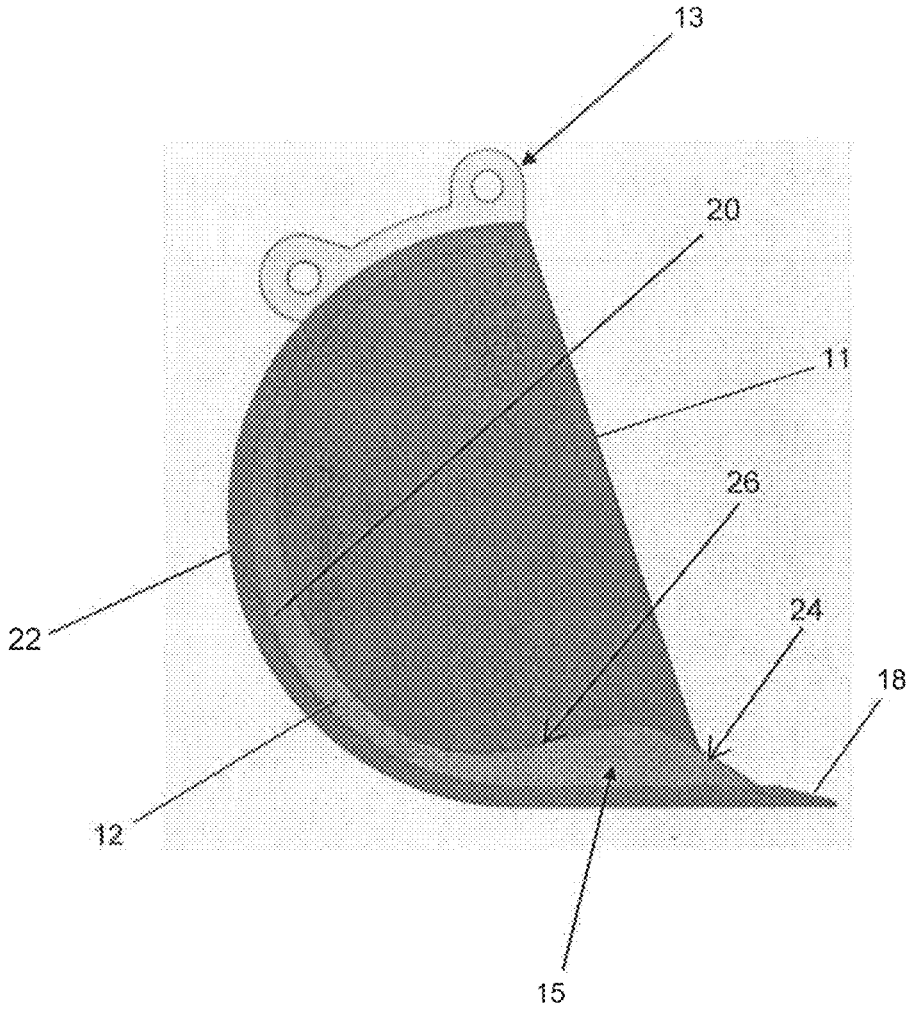
FIG. 3 is a cross-sectional view of the excavator bucket.

With reference to the figures, there is shown an excavator bucket 10 with side walls 11, a solid base wall 12 and mounting 13. The base wall 12 has an inwardly facing surface 20 and an outwardly facing surface 22 (see FIG. 3 for example). The base wall 12 has a front section 14 that has a convex or domed shaped portion 15. The front section 14 also has a raised, flat or concave shape 24. The convex or domed shaped portion 15 is substantially elongate extending partially across the front section 14 and slopes away towards each of the side walls 11. The base wall 12 also has a concave rear section 16. The leading edge 17 of the front section 14 has a plurality of outwardly protruding teeth 18. As can best be seen in FIG. 3, the base wall 12 has a discontinuous curve from the front section 14 to the rear section. The discontinuity 26 is located at the position where the base wall 12 changes from the concave rear section to the front section 14 having a convex or domed shaped portion 15.

The mounting 13 attaches to the hydraulically-operated arm of the excavator. With hydraulic rams, the bucket 10 can be tilted upwards and downwards. The hydraulically-operated arm can raise or lower the bucket 10.

In use the bucket 10 is tilted downward through the actuation of hydraulic rams. The arm of the excavator is lowered so that the teeth 18 penetrate the ground. Dirt passes into the bucket 10 flowing up the front section 14. The dirt is diverted from the domed shaped portion 15 towards the side walls 11 and concave rear section 16 of the bucket 10. In this way, the excavated dirt accumulates and is collected in the rear of the bucket 10. The domed shaped portion 15 serves to disrupt the flow of the excavated dirt so that it does not continue along the concave arc of the base wall 12 and is inadvertently discharged from the bucket 10. The domed shaped portion 15 also provides the advantage that it forms a raised lip extending partially across the front section 14 and prevents dirt from falling out of the front of the bucket 10. The domed shaped portion 15 also serves to divert excavated dirt to the sides and rear of the bucket 10. Consequently, a larger volume of excavated dirt can be collected (and moved) compared with current buckets when used under the same operational conditions.

The domed shaped portion 15 also provides structural strength to the front section 14 of the bucket 10. Consequently, the front section 14 (and base wall 12) can be made of thinner metal plate as structural integrity is contributed to by the domed shaped portion 15. With the front section 14 (and base wall 12) made of thinner metal plate, the bucket 10 will consequently weigh less and allow a higher volume (and weight) of excavated material to be collected and moved before the bucket 10 and excavator arm reaches its maximum operational threshold weight.

The preferred embodiment of the excavator bucket 10 uses the complementary advantages associated with the domed shaped portion 15, being providing structural integrity and allowing base walls 12 of thinner metal plate and accumulation and collection of a greater volume of excavated material; to move more excavated material per bucket load.

While we describe in the specification a bucket 10 for excavators, the bucket described above can also be used as a bucket for a loader. A bucket for a loader will have the same features as the excavator bucket except it will be wider.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A bucket for an excavator or a loader comprising:

a base wall having an inwardly facing surface that at least part of which has a concave shape and the base wall being a solid base wall;

two opposed side walls being spaced apart from one another by the base wall;

a mounting arrangement for mounting the bucket to the excavator or the loader;

wherein a front section of the inwardly facing surface of the base wall has a raised domed shaped portion and a rear section that has a concave shape, and the front section of the inwardly facing surface also has a raised, flat or concave shaped portion;

the inwardly facing surface of the base wall has a discontinuous curve from the front section to the rear section; and the domed shaped portion slopes towards the opposed side walls.

2. The bucket as claimed in claim 1, wherein the shape of the front section is discontinuous and not aligned with the concave shape of the rear section of the inwardly facing surface of the base wall.

3. The bucket as claimed in claim 1, wherein a cutting edge is adjacent the front section and remote from the rear section, the cutting edge is discontinuous with the front section.

4. The bucket as claimed in claim 1, wherein the raised domed shaped portion has a convex shape.

5. The bucket as claimed in claim 1, wherein the raised domed shaped portion of the front section serves to form a discontinuity with the rear section and assist in retaining excavated material within the bucket.

6. The bucket as claimed in claim 1, wherein the raised domed shaped portion is centrally located and forms an elongate domed portion.

7. The bucket as claimed in claim 1, wherein the mounting arrangement is associated with an outwardly facing side of the base wall.

8. The bucket as claimed in claim 1, wherein a cutting edge adjacent the front section has a plurality of teeth protruding outwardly to assist in penetrating a surface.

9. A bucket for an excavator or a loader including:

a base wall having an inwardly facing surface that at least part of which has a concave shape and the base wall being a solid base wall;

two opposed side walls being spaced apart from one another by the base wall;

a mounting arrangement for mounting the bucket to the excavator or the loader;

wherein the inwardly facing surface of the base wall has a front section that has a central convex domed shaped portion that slopes towards the side walls and a rear section that has a concave shape;

the inwardly facing surface of the base wall has a discontinuous curve from the front section to the rear section;

the central convex domed shaped portion with sloping sides of the front section is discontinuous with a concave arc of the rear section; and the front section cooperates with the concave shaped rear section to direct excavated material outwardly away from a center of the front section towards the side walls of the bucket as excavated material is received within the bucket and prevent the excavated material, received within the bucket, from inadvertently falling out of the bucket.

10. A bucket for an excavator or a loader comprising:

a base wall having an inwardly facing surface and an outwardly facing surface and the base wall being a solid base wall;

two side walls being connected to the base wall and spaced apart from one another by the base wall; and the outwardly facing surface of the base wall supporting a bucket mount for mounting the bucket to the excavator or the loader;

wherein the inwardly facing surface of the base wall has a front section with a raised domed shaped portion and a rear section with a concave shape, and the front section of the inwardly facing surface also has a raised, flat or concave shaped portion, and the raised domed shaped portion, during use, disrupts a flow of excavated material being received within the bucket and prevents the excavated material, received within the bucket, from inadvertently falling out of the bucket;

a cutting edge is adjacent the front section and remote from the rear section, and the cutting edge is discontinuous with the front section;

the inwardly facing surface of the base wall has a discontinuous curve from the front section to the rear section; and the domed shaped portion slopes towards each of the opposed side walls to direct excavated material outwardly away from a center of the front section towards the side walls of the bucket as excavated material is received within the bucket.

* * * * *